US005951269A

United States Patent [19]

Sasa et al.

[11] Patent Number: 5,951,269

[45] Date of Patent: Sep. 14, 1999

[54] SCROLL COMPRESSOR HAVING WELL-BALANCED ROTARY ELEMENTS

[75] Inventors: Takuji Sasa; Manabu Sakai; Shigeru Muramatsu, all of Kusatsu, Japan

[73] Assignee: Matsushita Electric Industrial Co., Ltd., Osaka-fu, Japan

[21] Appl. No.: 08/923,425

[22] Filed: Sep. 4, 1997

[30] Foreign Application Priority Data

Sep. 6, 1996 [JP] Japan ..... 8-236336

[51] Int. Cl.[6] ..... F04C 18/04

[52] U.S. Cl. ..... 418/55.1; 418/151

[58] Field of Search ..... 418/55.1, 151

[56] References Cited

U.S. PATENT DOCUMENTS 4,898,520 2/1990 Nieter et al. ..... 418/151
5,403,171 4/1995 Sugita et al. ..... 418/151

FOREIGN PATENT DOCUMENTS 59-215984 12/1984 Japan .
62-3186 1/1987 Japan ..... 418/151

*Primary Examiner*—John J. Vrablik
*Attorney, Agent, or Firm*—Wenderoth, Lind & Ponack, L.L.P.

[57] ABSTRACT

A scroll compressor has a closed vessel in which a compression mechanism having orbiting and stationary scroll elements in engagement with each other is accommodated. A crankshaft is coupled with the orbiting scroll element and rotatably supported by a crank bearing. The crankshaft is rotated by an electric motor having a stator and a rotor so that the orbiting scroll element may orbit relative to the stationary scroll element. A plurality of balance weights are provided for maintaining static and dynamic balances of rotary elements including the orbiting scroll element, the crankshaft, and the rotor. The static and dynamic balances are calculated using at least a clearance between the crankshaft and the crank bearing.

6 Claims, 6 Drawing Sheets

SCROLL COMPRESSOR HAVING WELL-BALANCED ROTARY ELEMENTS

BACKGROUND OF THE INVENTION

1. Field of the Invention

The present invention relates generally to a scroll compressor suited for use in, for example, an air conditioner for business or domestic use and, more particularly, to a scroll compressor having well-balanced rotary elements.

2. Description of Related Art

FIG. 3 or FIG. 4 depicts a scroll compressor comprising orbiting and stationary scroll elements 1 and 2 in engagement with each other, a crankshaft 6 coupled with the orbiting scroll element 1, and an electric motor 3 for rotating the crankshaft 6 to orbit the orbiting scroll element 1 relative to the stationary scroll element 2. The crankshaft 6 is rotatably supported by a crank bearing 4 and an auxiliary bearing 5. A rotation prevention mechanism 7 is provided for preventing the orbiting scroll element 1 from rotating about its own axis while permitting it to undergo an orbiting motion of an orbiting radius of $e_0$ relative to the stationary scroll element 2.

As shown in FIG. 5, during compression, the orbiting and stationary scroll elements 1 and 2 are held in line-contact with each other at a plurality of locations on internal and external surfaces thereof to define a plurality of crescent-shaped volume-variable working pockets therebetween. Each working pocket is gradually reduced in volume and increased in pressure as it approaches a center discharge port.

FIG. 6 schematically depicts how to balance a rotary machinery, while FIG. 7 schematically depicts a conventional method of balancing a scroll compressor.

As shown in FIGS. 6 and 7, the static balance and the dynamic balance have been calculated on the basis of the center of axis O of the crankshaft 6.

Static Balance:

$$F_0=m_0e_0\omega^2,\ F_{b1}=m_{b1}e_{b1}\omega^2,\ F_{b2}=m_{b2}e_{b2}\omega^2$$

Because $F_0+F_{b2}=F_{b1}$, $$m_0e_0+m_{b2}e_{b2}=m_{b1}e_{b1} \quad (1)$$

Dynamic Balance:

Because $F_0l_1=F_{b2}l_2$, $$m_0e_0l_1=m_{b2}e_{b2}l_2 \quad (2)$$

where $m_0$: off-centered eccentric mass, $e_0$: amount of eccentricity between the center of axis O of the crankshaft 6 and the eccentric mass $m_0$, $m_{b1}$: mass of a main balance weight 8 (=orbiting radius), $m_{b2}$: mass of an auxiliary balance weight 9, $e_{b1}$: distance between the main balance weight and a center of axis O, $e_{b2}$: distance between the auxiliary balance weight and the center of axis O, $l_1$: distance between $e_0$ and $e_{b1}$, and $l_2$: distance between $e_{b1}$ and $e_{b2}$.

Using Formulas (1) and (2) above, the values of $m_{b1}$, $m_{b2}$, $e_{b1}$, and $e_{b2}$ have been determined.

However, as disclosed in Japanese Laid-Open Patent Publication (unexamined) No. 59-215984, because the compression force acts as a rotating load in the scroll compressor, the crankshaft rotates while whirling within the crank bearing. In particular, the clearance between the crank bearing and the crankshaft is frequently set to a relatively large value in consideration of the clearance between mutually engaging blades of the orbiting and stationary scroll elements. Accordingly, the crankshaft actually rotates about it own axis while undergoing a whirling motion about the center of the crank bearing, thus producing an unbalanced exciting force. This force is one of the factors which enlarge vibrations of the rotary elements of the scroll compressor.

SUMMARY OF THE INVENTION

The present invention has been developed to overcome the above-described disadvantages.

It is accordingly an objective of the present invention to provide an improved scroll compressor having well-balanced rotary elements to minimize vibrations thereof.

In accomplishing the above and other objectives, the scroll compressor of the present invention comprises a closed vessel, a compression mechanism accommodated in the closed vessel and having orbiting and stationary scroll elements in engagement with each other, a crankshaft coupled with the orbiting scroll element, an electric motor having a stator and a rotor for rotating the crankshaft to orbit the orbiting scroll element relative to the stationary scroll element, a crank bearing for rotatably supporting the crankshaft, and balancing means for maintaining static and dynamic balances of rotary elements including the orbiting scroll element, the crankshaft, and the rotor. The static and dynamic balances are calculated using at least a clearance between the crankshaft and the crank bearing.

The above-described construction minimizes whirling of the crankshaft within the crank bearing, reducing vibrations of the scroll compressor.

Conveniently, the balancing means comprises a first balance weight secured to one of the crankshaft and the rotor and a second balance weight secured to one of the crankshaft and the rotor at a location farther than the first balance weight relative to the orbiting scroll element. The amount of eccentricity of the orbiting scroll element is regarded as being smaller half the clearance than the amount of eccentricity of the orbiting scroll element from a center of axis of the crankshaft, while the amount of eccentricity of the first balance weight is regarded as being greater half the clearance than the amount of eccentricity of the first balance weight from the center of axis of the crankshaft.

More specifically, the static balance is calculated using a formula given by:

$$m_0(e_0-\delta/2)+m_{b2}e_{b2}=m_{b1}(e_{b1}+\delta/2),$$

and the dynamic balance is calculated using a formula given by:

$$m_0(e_0-\delta/2)l_1=m_{b2}e_{b2}l_2,$$

where $m_0$: mass of the orbiting scroll element, $e_0$: amount of eccentricity between the center of axis of the crankshaft and the orbiting scroll element, $m_{b1}$: mass of the first balance weight, $m_{b2}$: mass of the second balance weight, $e_{b1}$: distance between the first balance weight and a center of the crankshaft, $e_{b2}$: distance between the second balance weight and the center of the crankshaft, $l_1$: distance between $e_0$ and $e_{b1}$, and $l_2$: distance between $e_{b1}$ and $e_{b2}$.

It is preferred that the rotary elements are regarded as being eccentric relative to a center of the crank bearing at a level of a center of gravity of all the rotary elements.

More specifically, the static balance is calculated using a formula given by:

$$m_0(e_0-\delta/2)+m_{b2}e_{b2}=m_{b1}(e_{b1}+\delta/2)+m\epsilon,$$

and the dynamic balance is calculated using a formula given by:

$$m_0(e_0-\delta/2)l_1+m\epsilon l_3=m_{b2}e_{b2}l_2,$$

where $m_0$: mass of the orbiting scroll element, $e_0$: amount of eccentricity between the center of axis of the crankshaft and the orbiting scroll element, $m_{b1}$: mass of the first balance weight, $m_{b2}$: mass of the second balance weight, $e_{b1}$: distance between the first balance weight and a center of the crankshaft, $e_{b2}$: distance between the second balance weight and the center of the crankshaft, $l_1$: distance between $e_0$ and $e_{b1}$, $l_2$: distance between $e_{b1}$ and $e_{b2}$, m: mass of all the rotary elements, and $\epsilon$: distance between the center of gravity of all the rotary elements and the center of the crank bearing.

Advantageously, the scroll compressor further comprises another bearing for rotatably supporting the crankshaft, wherein the crank bearing is a sleeve bearing, while the another bearing is a rolling bearing.

BRIEF DESCRIPTION OF THE DRAWINGS

The above and other objectives and features of the present invention will become more apparent from the following description of preferred embodiments.

BRIEF DESCRIPTION OF THE DRAWINGS

Figure 1:
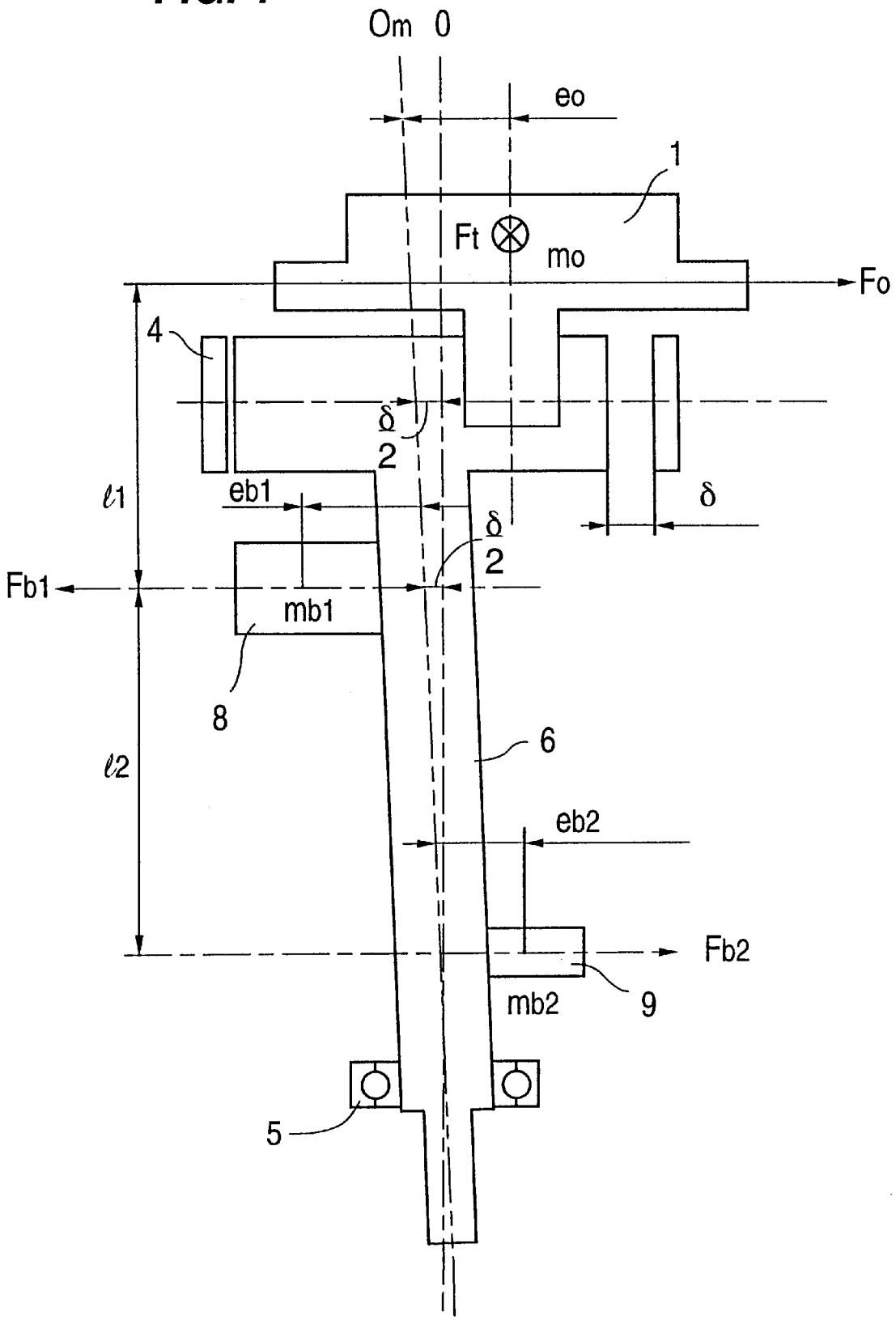
Figure 2:
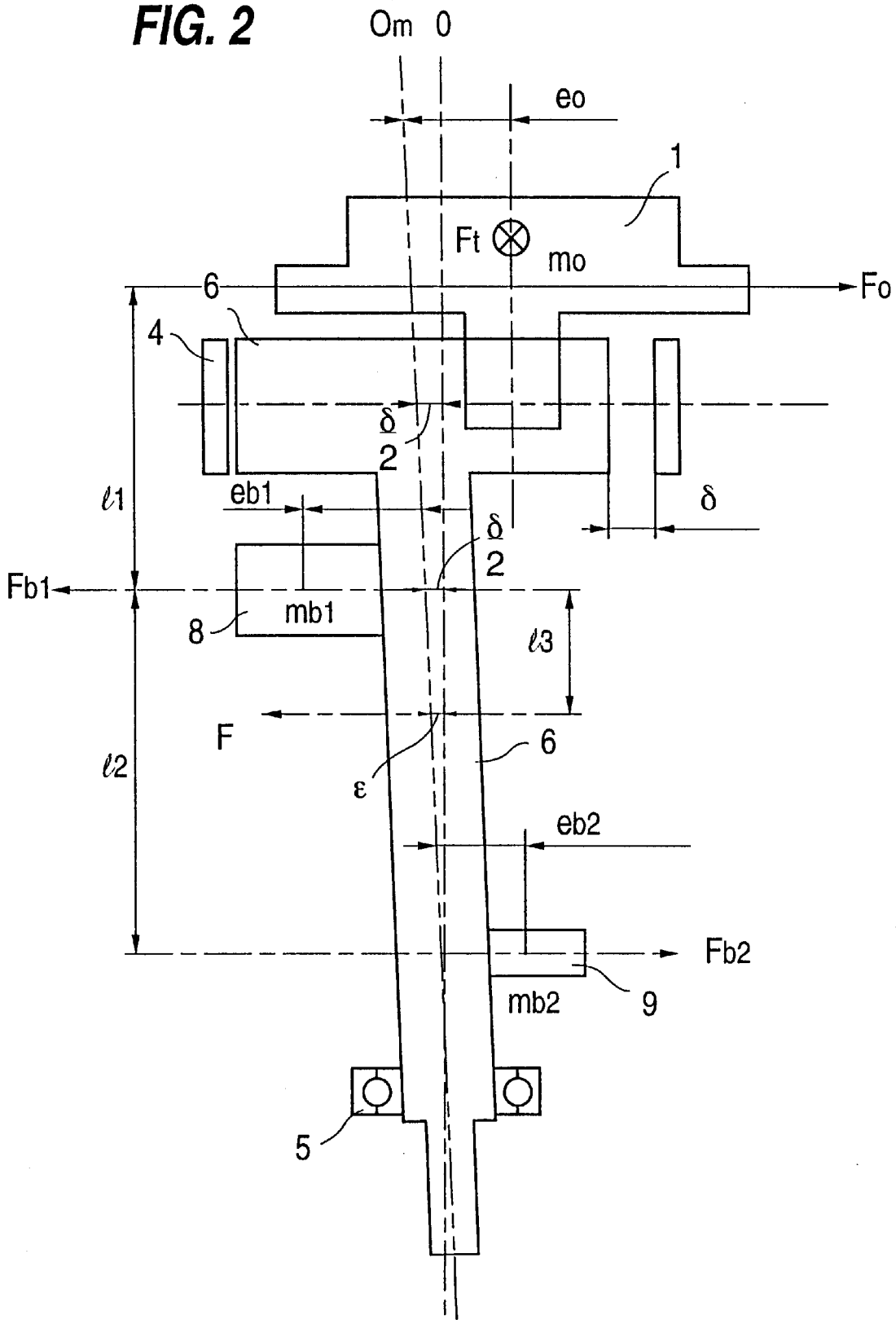
Figure 3:
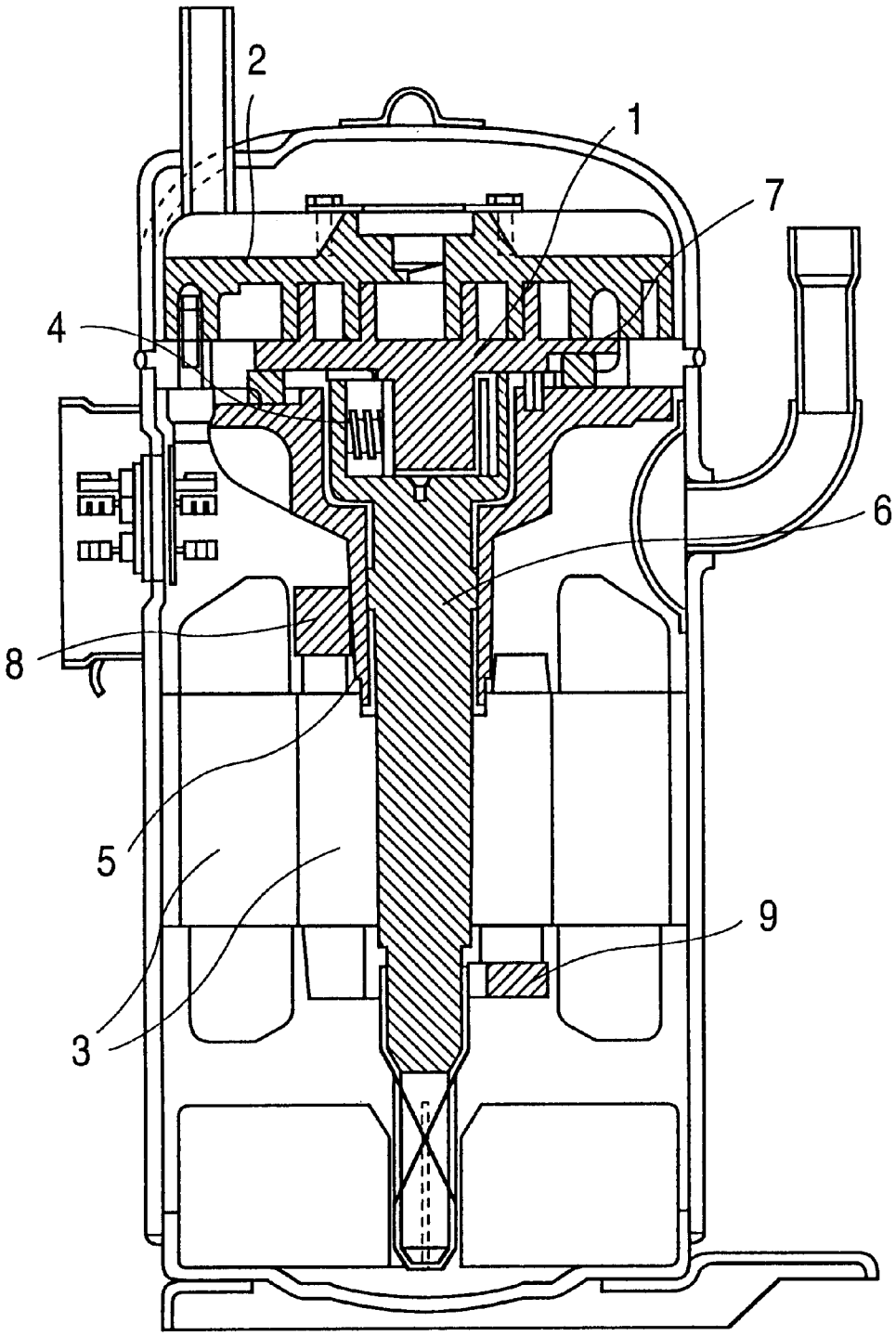
Figure 4:
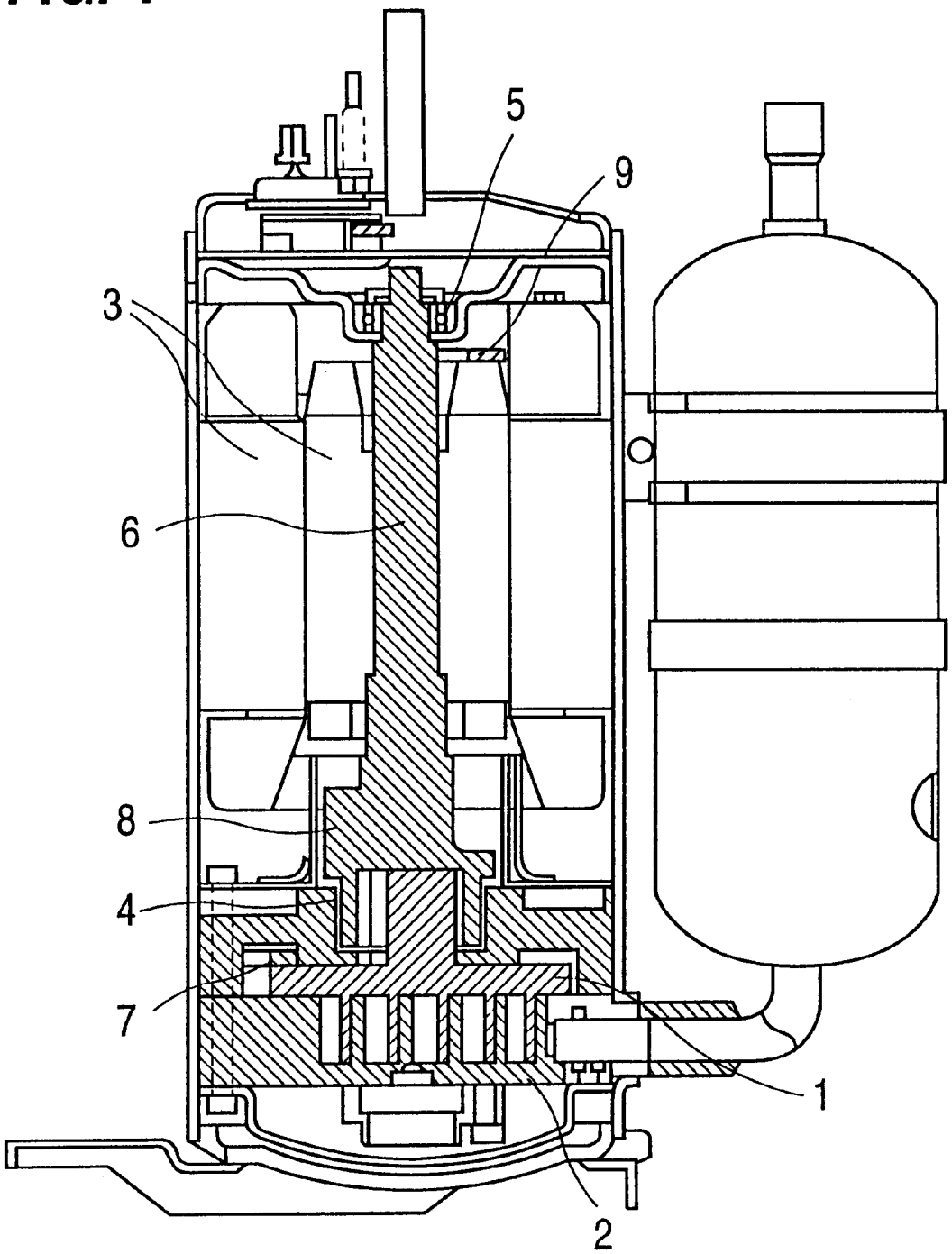
Figure 5:
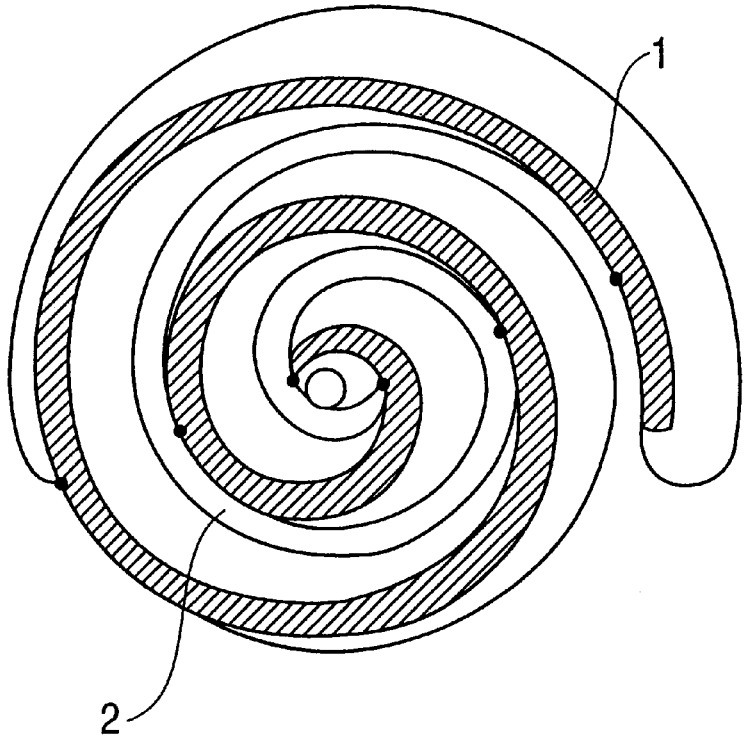
Figure 6:
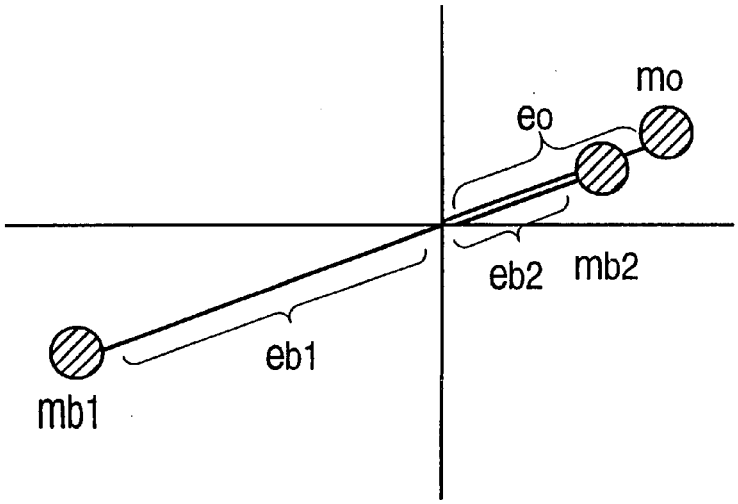
Figure 7:
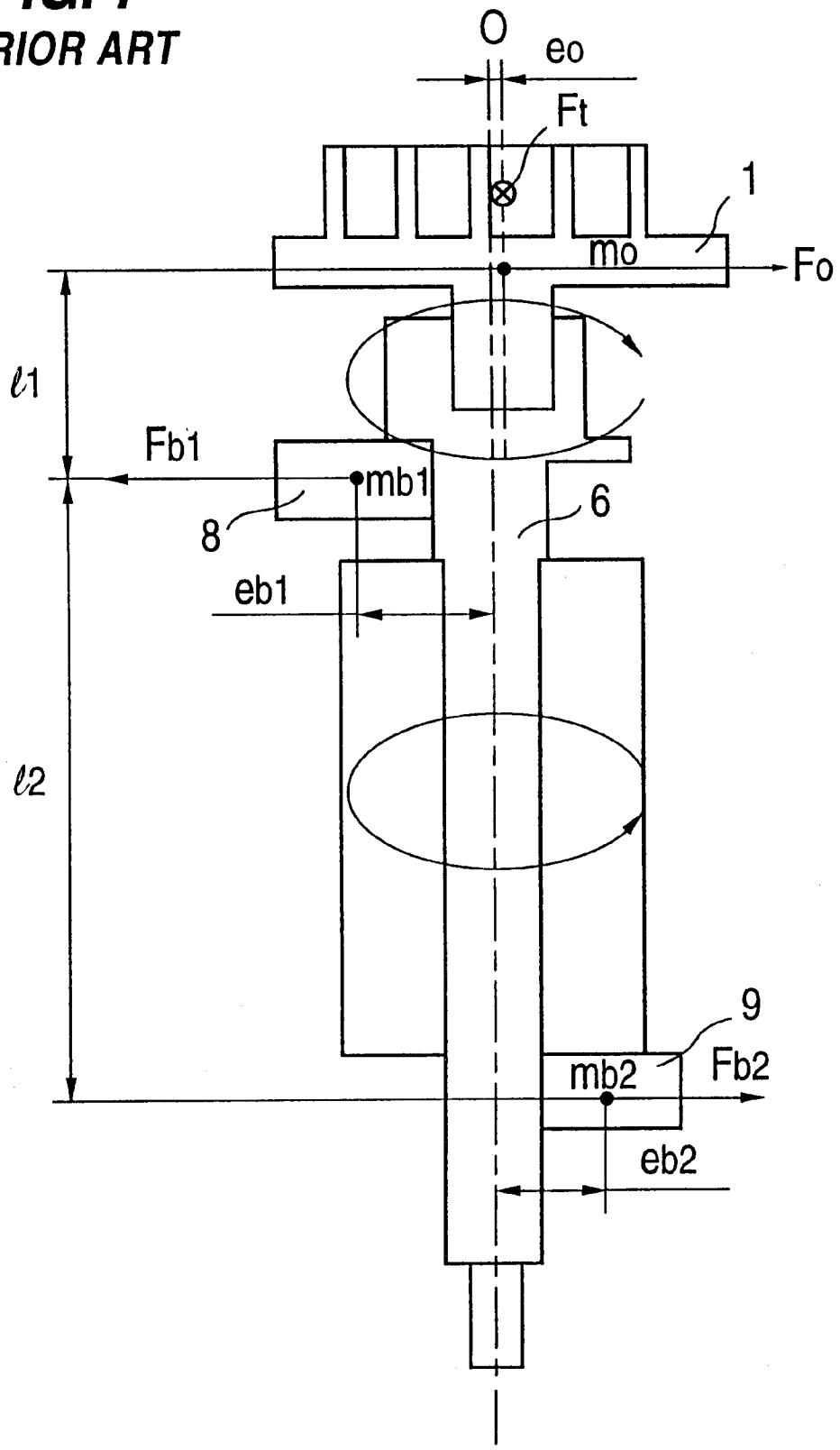
FIG. 7 PRIOR ART

The above and other objectives and features of the present invention will become more apparent from the following description of preferred embodiments thereof with reference to the accompanying drawings, throughout which like parts are designated by like reference numerals, and wherein:

FIG. 1 is a schematic view of rotary elements of a scroll compressor according to a first embodiment of the present invention, particularly depicting how to balance the rotary elements;

FIG. 2 is a view similar to FIG. 1, but according to a second embodiment of the present invention;

FIG. 3 is a vertical sectional view of a scroll compressor to which the present invention is applied;

FIG. 4 is a vertical sectional view of another scroll compressor to which the present invention is applied;

FIG. 5 is a top plan view, partly in section, of orbiting and stationary scroll elements in engagement with each other;

FIG. 6 is a schematic diagram depicting how to balance a rotary machinery; and FIG. 7 is a schematic view of rotary elements of a scroll compressor, particularly depicting a conventional method of balancing the rotary elements.

DETAILED DESCRIPTION OF THE PREFERRED EMBODIMENTS

This application is based on an application No. 8-236336 filed in Japan, the content of which is incorporated hereinto by reference.

The present invention is applied to scroll compressors as shown in FIGS. 3 and 4. Accordingly, the present invention is discussed hereinafter with reference to FIGS. 3 and 4.

The scroll compressor to which the present invention is applied comprises a closed vessel, orbiting and stationary scroll elements 1 and 2 in engagement with each other, a crankshaft 6 coupled with the orbiting scroll element 1, an electric motor 3 for rotating the crankshaft 6 to orbit the orbiting scroll element 1 relative to the stationary scroll element 2, and a rotation prevention mechanism 7 for preventing the orbiting scroll element 1 from rotating about its own axis while permitting it to undergo an orbiting motion of an orbiting radius of $e_0$ relative to the stationary scroll element 2.

As shown in FIG. 1, the crankshaft 6 is rotatably supported by a crank bearing 4 and an auxiliary bearing 5. The crank bearing 4 is a sleeve bearing, while the auxiliary bearing 5 is a rolling bearing. The crankshaft 6 is provided with a main balance weight 8 secured thereto or integrally formed therewith at a location close to the orbiting scroll element 1 and an auxiliary balance weight 9 secured thereto at a location remote from the orbiting scroll element 1. The main balance weight 8 and the auxiliary balance weight 9 may be secured to a rotor of the electric motor 3 or any other element rotating with the rotor. Furthermore, the main balance weight 8 is positioned opposite to the direction of eccentricity of the orbiting scroll element 1, while the auxiliary balance weight 8 is positioned in the direction of eccentricity.

In the above-described construction, compression of a refrigerant by the compression mechanism causes a gas force $F_t$ to always act in a direction perpendicular to the direction of eccentricity. If there is a clearance $\delta$ between the crank bearing 4 and the crankshaft 6, the gas force $F_t$ and the centrifugal force $F_{b1}$ of the main balance weight 8 causes the crankshaft 6 to undergo a whirling motion within the crank bearing 4. This motion is known as precession in which the center of axis Om of the crankshaft 6 is offset half ($\delta/2$) the clearance of the crank bearing 4 from the center O of the crank bearing 4 at the level of the crank bearing 4.

In that case, the orbiting radius of the orbiting scroll element 1 is not $e_0$ but is smaller than it by half the clearance $\delta$ of the crank bearing 4.

Accordingly, when the whirling of the crankshaft 6 within the clearance $\delta$ is taken into account, Formulas (1) and (2) are expressed as follows:

Static Balance:

$$m_0(e_0-\delta/2)+m_{b2}e_{b2}=m_{b1}(e_{b1}+\delta/2) \quad (3)$$

Dynamic Balance:

$$m_0(e_0-\delta/2)l_1=m_{b2}e_{b2}l_2 \quad (4)$$

Using Formulas (3) and (4), the values of $m_{b1}$, $m_{b2}$, $e_{b1}$, and $e_{b2}$ are determined, thereby properly setting the size of the main balance weight 8 and that of the auxiliary balance weight 9.

Setting the balance weights 8 and 9 in the above-described manner can eliminate the whirling of the crankshaft 6, resulting in a low-vibration scroll compressor.

As shown in FIG. 2, if it is considered that the whole crankshaft system undergoes precession about the center O of the crank bearing 4, it should be further considered that the crankshaft system itself would create an unbalance exciting force. This exciting force corresponds to the mass m of the crankshaft system whirling by an amount of eccentricity E from the center O of the crank bearing 4 at a level of the center of gravity of the crankshaft system.

When this exciting force is taken into account, Formulas (1) and (2) above can be expressed as follows:

Static Balance:

$$m_0(e_0-\delta/2)+m_{b2}e_{b2}=m_{b1}(e_{b1}+\delta/2)+m\epsilon \quad (5)$$

Dynamic Balance:

$$m_0(e_0-\delta/2)l_1=m\epsilon l_3=m_{b2}e_{b2}l_2 \quad (6)$$

Using Formulas (5) and (6), the values of $m_{b1}$, $m_{b2}$, $e_{b1}$, and $e_{b2}$ are determined, thereby properly setting the size of the main balance weight 8 and that of the auxiliary balance weight 9.

Setting the sizes of the balance weights 8 and 9 in the above-described manner can eliminate the whirling of the crankshaft 6, thus making it possible to provide a considerably low-vibration scroll compressor.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A scroll compressor comprising:

a closed vessel;

a compression mechanism accommodated in said closed vessel and having orbiting and stationary scroll elements in engagement with each other;

a crankshaft coupled with said orbiting scroll element;

an electric motor having a stator and a rotor for rotating said crankshaft to orbit said orbiting scroll element relative to said stationary scroll element;

a crank bearing for rotatably supporting said crankshaft; and balancing means for maintaining static and dynamic balances of rotary elements including said orbiting scroll element, said crankshaft, and said rotor;

wherein the static and dynamic balances are calculated using at least a clearance between said crankshaft and said crank bearing.

2. The scroll compressor according to claim 1, wherein said balancing means comprises a first balance weight secured to one of said crankshaft and said rotor and a second balance weight secured to one of said crankshaft and said rotor at a location farther than said first balance weight relative to said orbiting scroll element, and wherein an amount of eccentricity of said orbiting scroll element is regarded as being smaller half the clearance than an amount of eccentricity of said orbiting scroll element from a center of axis of said crankshaft, while an amount of eccentricity of said first balance weight is regarded as being greater half the clearance than an amount of eccentricity of said first balance weight from the center of axis of said crankshaft.

3. The scroll compressor according to claim 2, wherein the static balance is calculated using a formula given by:

$$m_0(e_0-\delta/2)+m_{b2}e_{b2}=m_{b1}(e_{b1}+\delta/2),$$

and the dynamic balance is calculated using a formula given by:

$$m_0(e_0-\delta/2)l_1=m_{b2}e_{b2}l_2,$$

where $m_0$: mass of said orbiting scroll element, $e_0$: amount of eccentricity between the center of axis of said crankshaft and said orbiting scroll element, $m_{b1}$: mass of said first balance weight, $m_{b2}$: mass of said second balance weight, $e_{b1}$: distance between said first balance weight and a center of said crankshaft, $e_{b2}$: distance between said second balance weight and the center of said crankshaft, $l_1$: distance between $e_0$ and $e_{b1}$, and $l_2$: distance between $e_{b1}$ and $e_{b2}$.

4. The scroll compressor according to claim 1, wherein said rotary elements are regarded as being eccentric relative to a center of said crank bearing at a level of a center of gravity of all said rotary elements.

5. The scroll compressor according to claim 4, wherein the static balance is calculated using a formula given by:

$$m_0(e_0-\delta/2)+m_{b2}e_{b2}=m_{b1}(e_{b1}+\delta/2)+m\epsilon,$$

and the dynamic balance is calculated using a formula given by:

$$m_0(e_0-\delta/2)l_1+m\epsilon l_3=m_{b2}e_{b2}l_2,$$

where $m_0$: mass of the orbiting scroll element, $e_0$: amount of eccentricity between the center of axis of said crankshaft and said orbiting scroll element, $m_{b1}$: mass of said first balance weight, $m_{b2}$: mass of said second balance weight, $e_{b1}$: distance between said first balance weight and a center of said crankshaft, $e_{b2}$: distance between said second balance weight and the center of said crankshaft, $l_1$: distance between $e_0$ and $e_{b1}$, $l_2$: distance between $e_{b1}$ and $e_{b2}$, m: mass of all said rotary elements, and $\epsilon$: distance between the center of gravity of all the rotary elements and the center of said crank bearing.

6. The scroll compressor according to claim 1, and further comprising another bearing for rotatably supporting said crankshaft, wherein said crank bearing is a sleeve bearing, while said another bearing is a rolling bearing.

* * * * *